US008833752B2

(12) United States Patent
Tsutsui et al.

(10) Patent No.: US 8,833,752 B2
(45) Date of Patent: Sep. 16, 2014

(54) SHEET FEEDING DEVICE

(71) Applicants: Kyoko Tsutsui, Obu (JP); Koyo Yamamoto, Nisshin (JP)

(72) Inventors: Kyoko Tsutsui, Obu (JP); Koyo Yamamoto, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/796,733

(22) Filed: Mar. 12, 2013

(65) Prior Publication Data

US 2013/0256975 A1 Oct. 3, 2013

(30) Foreign Application Priority Data

Mar. 30, 2012 (JP) ..... 2012-078466

(51) Int. Cl.
*B65H 3/44* (2006.01)

(52) U.S. Cl.
USPC ..... 271/9.09; 271/127; 271/162

(58) Field of Classification Search
USPC ..... 271/9.09, 127, 162; 399/392
See application file for complete search history.

(56) References Cited

U.S. PATENT DOCUMENTS

| | | | | |
|---|---|---|---|---|
| 7,306,217 | B2 * | 12/2007 | Bandou et al. | 271/145 |
| 2006/0017217 | A1 | 1/2006 | Maeda | |
| 2006/0220295 | A1 | 10/2006 | Bandou et al. | |
| 2011/0241286 | A1 | 10/2011 | Ishii | |

FOREIGN PATENT DOCUMENTS

| | | | |
|---|---|---|---|
| EP | 1707389 | A2 | 10/2006 |
| JP | 10-218435 | A | 8/1998 |
| JP | 10-231031 | A | 9/1998 |
| JP | 4741988 | B2 | 8/2011 |

OTHER PUBLICATIONS

EP Extended Search Report mailed Jul. 29, 2014, EP Appln. 13159783.3.

* cited by examiner

*Primary Examiner* — Michael McCullough
(74) *Attorney, Agent, or Firm* — Banner & Witcoff, Ltd.

(57) ABSTRACT

In a sheet feeding device, a main body includes a feeding unit configured to feed a sheet in a feeding direction to a conveying path. A cover is configured to pivot about a first axis relative to the main body between a closed position in which the cover closes the conveying path and an open position in which the cover exposes the conveying path. A plate is configured to pivot about a second axis which is parallel to the first axis and to contact and move away from the feeding unit. The second axis is closer to the cover than to the feeding unit in the feeding direction. In a state in which the cover is in the closed position, at least a part of the cover is positioned on an upper side of the plate so as to be contactable with the plate.

19 Claims, 8 Drawing Sheets

SHEET FEEDING DEVICE

CROSS REFERENCE TO RELATED APPLICATION

This application claims priority from Japanese Patent Application No. 2012-078466, filed on Mar. 30, 2012, the entire disclosure of which is incorporated herein by reference.

BACKGROUND OF THE INVENTION

1. Field of the Invention

The present invention relates to a sheet feeding device.

2. Description of Related Art

A known sheet feeding device is configured to feed a sheet in a feeding direction and comprises a main body, a cover, and a plate.

The main body comprises a feeding unit configured to feed a sheet to a conveying path along which a sheet is conveyed. The cover is configured to pivot about a first axis relative to the main body. The cover is movable between a closed position in which the cover closes the feeding path and an open position in which the cover exposes the feeding path. The plate is configured to pivot about a second axis, which is parallel to the first axis, so as to contact and move away from the feeding unit.

In the sheet feeding device, the plate pivots about the second axis depending on the number of sheets on the plate such that a topmost sheet contacts the feeding unit, and the feeding unit feeds the topmost sheet to the conveying path.

In such a known sheet feeding device, in order to prevent breakage of a plate for holding sheets, it is common to restrict excessive deformation of the plate by increasing the thickness of the plate or by assembling a reinforcing member into the plate. In this case, however, the height of the plate may increase, and it may be difficult to reduce the size of the sheet feeding device in the height direction.

SUMMARY OF THE INVENTION

Therefore, a need has arisen for a sheet feeding device that overcomes these and other shortcomings of the related art and achieves prevention of breakage of a sheet holding plate while reducing the size of the sheet feeding device in the height direction.

According to an embodiment of the invention, a sheet feeding device comprises a main body comprising a feeding unit configured to feed a sheet in a feeding direction to a conveying path along which the sheet is conveyed, a cover configured to pivot about a first axis relative to the main body between a closed position in which the cover closes the conveying path and an open position in which the cover exposes the conveying path, and a plate configured to pivot about a second axis which is parallel to the first axis and to contact and move away from the feeding unit. The second axis is closer to the cover than to the feeding unit in the feeding direction. In a state in which the cover is in the closed position, at least a part of the cover is positioned on an upper side of the plate so as to be contactable with the plate.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-10, like numerals being used for like corresponding parts in the various drawings.

Figure 1:
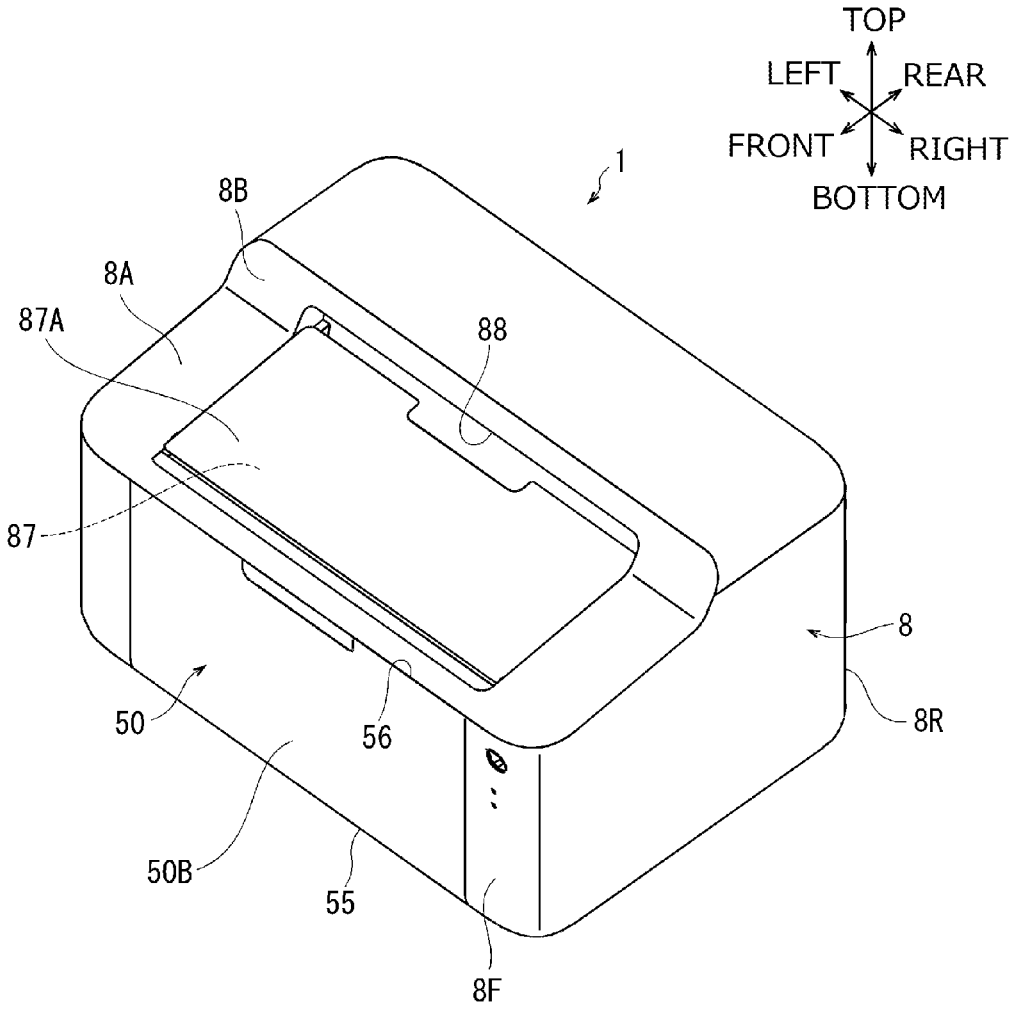
FIG. 1 is a perspective view of a sheet feeding device, e.g., an image forming device, according to an embodiment of the invention.

An image forming device 1 shown in FIG. 1 is an exemplary embodiment of a sheet feeding device of the present invention. In FIG. 1, a side on which a tray cover 50 is disposed is defined as a front side, and a left side of a viewer facing the front cover 50 is defined as a left side. A front-rear direction, a left-right direction, and a top-bottom direction are indicated with reference to the front side and the left side. Directions in FIGS. 2 to 10 correspond to the directions indicated in FIG. 1. The components of the image forming device 1 will now be described with reference to FIG. 1 and other drawings.

Figure 2:
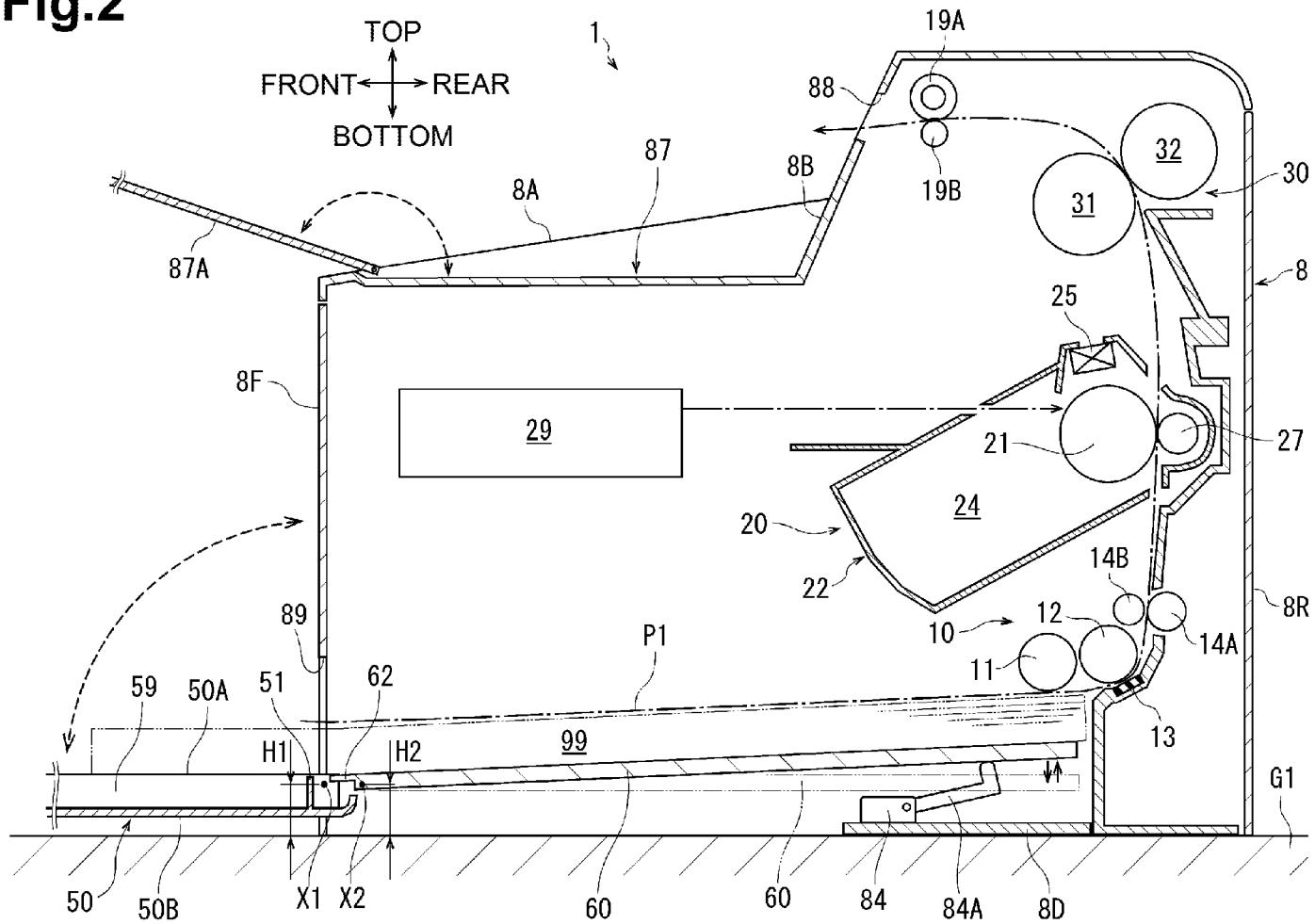
FIG. 2 is a schematic sectional view of the image forming device.

As shown in FIGS. 1 and 2, the image forming device 1 comprises a main body 8, the tray cover 50, a plate 60, a feeding unit 10, an image forming unit 20, a fixing unit 30, a discharge roller 19A, and a driven roller 19B. The tray cover 50 is an example of a cover.

As shown in FIG. 2, the main body 8 has a substantially box shape with a step, and a rear surface 8R of the main body 8 has a height larger than that of a front surface 8F thereof. An opening 89 is formed in the lower part of the front surface 8F of the main body 8 so as to bring the interior of the main body 8 into communication with the exterior.

Figure 3:
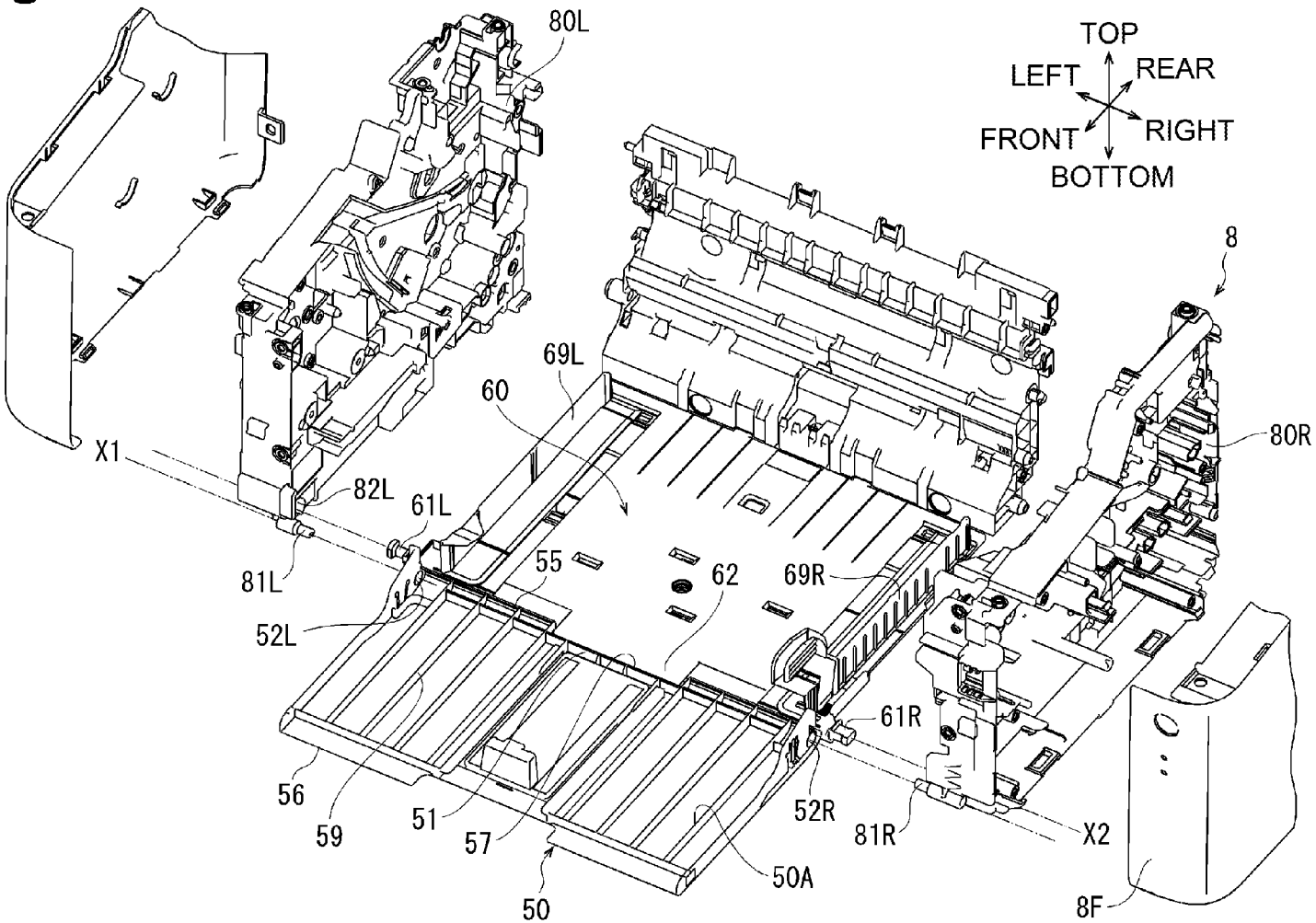
FIG. 3 is an exploded perspective view of a tray cover, a plate, and a pair of inner side frames and the like of the image forming device.

As shown in FIG. 3, a pair of left and right inner side frames 80L and 80R and other frames (not shown) are provided inside the main body 8. The inner side frames 80L and 80R are spaced from and face the left and right side surfaces of the main body 8, respectively, and have a substantially flat plate shape extending in the top-bottom and front-rear directions. The term "substantially flat plate shape" herein refers to an element which is substantially flat plate-shaped and may include a protrusion, a hollow, and a rib. Similarly, an element which is "substantially vertical" and an element which is "substantially horizontal" may include a protrusion, a hollow, and a rib.

As shown in FIG. 2, a discharge tray 87 is formed in an upper surface 8A of the main body 8, and the upper surface 8A extends rearward from the upper end of the front surface 8F. In addition, an auxiliary tray 87A is provided on the upper surface 8A. The auxiliary tray 87A is held by the main body 8 so as to be able to change its state between a state in which the auxiliary tray 87A covers the discharge tray 87 from above as shown in FIG. 1, and a state in which the auxiliary tray 87A is opened to the front side of the discharge tray 87 as shown in FIG. 2.

A standing wall surface 8B is provided so as to extend upward from the rear edge of the discharge tray 87 formed in the upper surface 8A of the main body 8. A discharge port 88 is formed in the upper part of the standing wall surface 8B so as to bring the interior of the main body 8 into communication with the exterior.

The tray cover 50 and the plate 60 are provided at the bottom of the main body 8 as shown in FIG. 2. In the present embodiment, the tray cover 50 and the plate 60 are formed, for example, by injection molding of thermoplastic resin. The tray cover 50 and the plate 60 may be made by any other procedure than the injection molding. Any reinforcing components such as a metal plate are not attached to the cover 50 and the plate 60.

The tray cover 50 is held on the side near the front surface 8F of the main body 8 so as to be pivotable about a first axis X1 extending in the left-right direction. Specifically, as shown in FIG. 3, the inner side frames 80L and 80R have a pair of left and right main-body-side shafts 81L and 81R formed at the front lower corners of the inner side frame 80L and 80R, respectively. The main-body-side shafts 81L and 81R are aligned with the first axis X1 and protrude cylindrically in directions closer to each other. On the other hand, the tray cover 50 has cover-side shaft holes 52L and 52R aligned with the first axis X1 and formed at positions facing the main-body-side shafts 81L and 81R, respectively. The main-body-side shafts 81L and 81R are inserted into the cover-side shaft holes 52L and 52R, respectively, such that the tray cover 50 is held by the main body 8 so as to be pivotable about the first axis X1.

The opening 89 is closed in a state in which the tray cover 50 stands as shown in FIG. 1. In contrast, the opening 89 is exposed in a state in which the tray cover 50 extends frontward substantially horizontally as shown in FIG. 2.

The position of the tray cover 50 shown in FIG. 1 is an example of a closed position. The position of the tray cover 50 shown in FIG. 2 is an example of an open position. The tray cover 50 in the closed position shown in FIG. 1 closes the opening 89 so as to close a conveying path P1 which will be described later. In contrast, the tray cover 50 in the open position shown in FIG. 2 opens the opening 89 so as to expose the most upstream side of the conveying path P1.

As shown in FIGS. 2 and 3, a plurality of ribs 59 are provided on a surface of the tray cover 50 so as to extend in the front-rear direction, and the surface faces up in a state in which the tray cover 50 is in the open position. The upper edge faces of the ribs 59 constitute a sheet holding surface 50A on which a stack of sheets 99 is placed.

As shown in FIG. 2, the plate 60 is a substantially flat plate-shaped member provided at the bottom of the main body 8 so as to extend substantially horizontally. The plate 60 extends toward a side opposite from the tray cover 50 in the open position, namely, toward the rear surface 8R of the main body 8. In a state in which the tray cover 50 is in the open position, the sheets 99 to be placed on the sheet holding surface 50A are inserted into the main body 8 and supported by the plate 60 from below.

The rear edge of the plate 60 is positioned below the feeding unit 10 which will be described later. The front edge of the plate 60 is held by the main body 8 such that the plate 60 is pivotable about a second axis X2 which is parallel to the first axis X1. Specifically, as shown in FIG. 3, the inner side frames 80L and 80R have a pair of left and right main-body-side shaft holes (only a main-body-side shaft hole 82L on the left side is shown) provided in the rear of the main-body-side shafts 81L and 81R, respectively, and aligned with the second axis X2. On the other hand, the plate 60 has a pair of left and right plate-side shafts 61L and 61R provided at positions facing the left main-body-side shaft hole 82L and the right main-body-side shaft hole, respectively, and aligned with the second axis X2. The plate-side shafts 61L and 61R are inserted into the left main-body-side shaft hole 82L and the right main-body-side shaft hole, respectively, such that the plate 60 is held by the main body 8 so as to be pivotable about the second axis X2.

In the present embodiment, the sheets 99 placed on the sheet holding surface 50A are fed in a direction from the front surface 8F of the main body 8 to the rear surface 8R as shown in FIG. 2. The second axis X2 is positioned closer to the tray cover 50 than to the feeding unit 10 in the direction in which the sheets 99 are fed. A height H1 of the first axis X1 is equal to a height H2 of the second axis X2.

Figure 4:
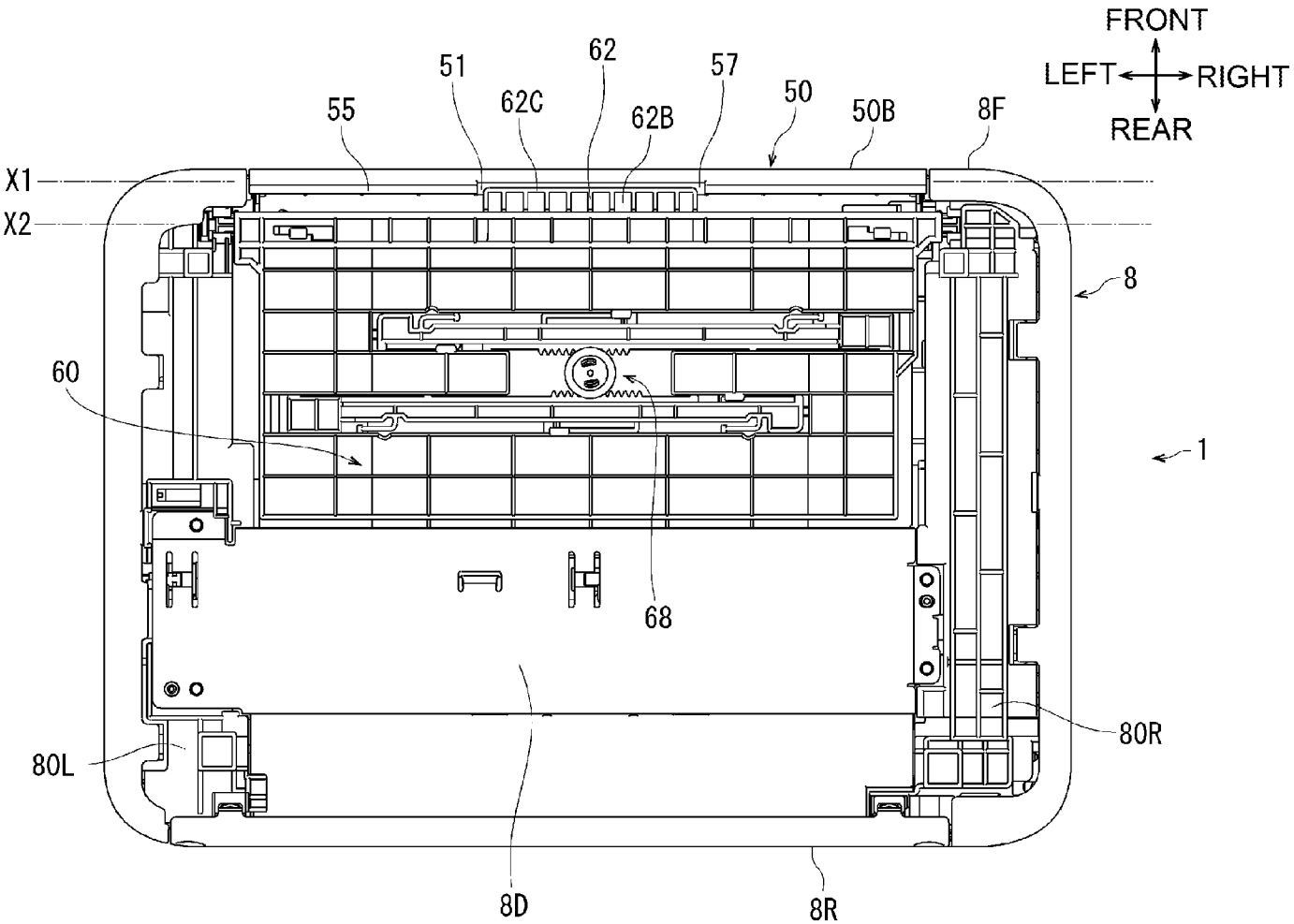
FIG. 4 is a bottom view of the image forming device in a state in which the tray cover is in a closed position.

As shown in FIGS. 2 and 4, a bottom plate 8D is attached to the bottom of the main body 8 on the side near the rear surface 8R. The bottom plate 8D has a rectangular shape extending in the left-right direction. The left and right ends of the bottom plate 8D are fixed to the inner side frames 80L and 80R, respectively. No bottom plate is provided in a front region of the bottom of the main body 8. The front region is in front of the bottom plate 8D. A region of the plate 60 in front of the bottom plate 8D and a region of the tray cover 50 below the first axis X1 are therefore exposed to a mounting surface G1 on which the image forming device 1 is mounted, as shown in FIG. 2. Specifically, as shown in FIGS. 2 and 4, a portion of the plate 60 which is closer to the cover than to the feeding unit 10 is exposed to the mounting surface G1. The middle part of the plate 60 between the plate-side shafts 61L and 61R is exposed to the mounting surface G1.

As shown in FIG. 2, a tilting mechanism 84 having a pivot lever 84A is provided between the bottom plate 8D and the plate 60. The tilting mechanism 84 pivots the pivot lever 84A, as indicated by a solid line and a two-dot chain line in FIG. 2, thereby to change the inclination of the plate 60. The plate 60 can hence move toward and away from the feeding unit 10.

As shown in to FIG. 3, a pair of left and right side guides 69L and 69R are provided on the upper surface of the plate 60 so as to be slidable in the left-right direction. The side guides 69L and 69R face each other in the left-right direction while extending in the front-rear direction.

As shown in FIG. 4, a rack-and-pinion mechanism 68 is provided at the bottom of the plate 60. The side guides 69L and 69R are coupled to the rack-and-pinion mechanism 68. This structure enables the side guides 69L and 69R to move, on the plate 60, closer to and away from each other in the left-right direction, and to position the sheets 99 on the sheet holding surface 50A in the width direction thereof. In the present embodiment, the width direction of the sheets 99 placed on the sheet holding surface 50A corresponds to the left-right direction.

The tray cover 50 and the plate 60 are configured to reinforce each other. When one of these components is deformed, the other component contacts the deformed component so as to restrict excessive deformation of the deformed component. This structure will be described later in detail with reference to FIGS. 5 to 10.

As shown in FIG. 2, the main body 8 has the conveying path P1 along which the sheets 99 on the sheet holding surface 50A and the plate 60 are conveyed. The conveying path P1 extends from a point above the sheet holding surface 50A toward the rear edge of the plate 60. The conveying path P1 further extends toward the rear surface 8R of the main body 8 and then turns upward in a substantially vertical direction. Then, the conveying path P1 changes the direction, at a position near the upper edge of the rear surface 8R of the main body 8, toward the front side and extends to the discharge port 88. The conveying path P1 is substantially C-shaped.

The image forming device 1 comprises a feed roller 11, a separation roller 12, a separation pad 13, a convey roller 14A, a driven roller 14B, the image forming unit 20, the fixing unit 30, a discharge roller 19A, and a driven roller 19B, which are provided along the conveying path P1.

The feeding unit 10 comprises the feed roller 11, the separation roller 12, the separation pad 13, the convey roller 14A, and the driven roller 14B.

The feed roller 11 is positioned above the rear edge of the plate 60. The tilting mechanism 84 operates depending on the number of the sheets 99 on the plate 60 to increase or decrease the inclination of the plate 60, such that the topmost sheet 99 contacts the feed roller 11.

The separation roller 12 and the separation pad 13 are provided in the rear of the feed roller 11 at a position at which the conveying path P1 turns upward. The separation pad 13 faces the separation roller 12 with the conveying path P1 interposed therebetween and is pressed against the separation roller 12. The convey roller 14A and the driven roller 14B are positioned above the separation roller 12. The driven roller 14B faces the convey roller 14A with the conveying path P1 interposed therebetween and rotates in response to the rotation of the convey roller 14A.

The image forming unit 20 comprises a process cartridge 22 and a scanning unit 29.

The process cartridge 22 has a substantially box shape which extend in the left-right direction and through which the substantially vertical part of the conveying path P1 passes. The process cartridge 22 is attached to a frame (not shown) of the main body 8. The process cartridge 22 accommodates a photosensitive drum 21, a transfer roller 27, a toner container 24 for supplying toner to the photosensitive drum 21, and a charger 25 for positively charging the photosensitive drum 21 by corona discharge.

The photosensitive drum 21 is a cylindrical member extending in the left-right direction and faces the substantially vertical part of the conveying path P1 from the front side. The transfer roller 27 faces the photosensitive drum 21 with the conveying path P1 interposed therebetween. The photosensitive drum 21 and the transfer roller 27 rotate together while nipping the sheet 99 conveyed along the substantially vertical part of the conveying path P1. The charger 25 is spaced above from the photosensitive drum 21 and extends in the left-right direction in parallel with the photosensitive drum 21.

The scanning unit 29 is positioned in front of the process cartridge 22. The scanning unit 29 comprises a laser source, a polygon mirror, an f-theta lens, and a reflection mirror. The scanner unit 29 emits a laser beam from the front side to the photosensitive drum 21.

The fixing unit 30 is positioned at the substantially vertical part of the conveying path P1 and above the photosensitive drum 21 and the transfer roller 27. The fixing unit 30 comprises a heat roller 31 facing the conveying path P1 from the front side, and a pressure roller 32 facing the heat roller 31 with the conveying path P1 interposed therebetween.

The discharge roller 19A and the driven roller 19B are positioned on the most downstream side of the conveying path P1, namely, at a position at which the conveying path P1 is directed to the front side. The discharge roller 19A and the driven roller 19B face the discharge port 88. The driven roller 19B faces the discharge roller 19A with the conveying path P1 interposed therebetween and rotates in response to the rotation of the discharge roller 19A.

The image forming device 1 forms an image on the sheet 99 placed on the sheet holding surface 50A in the manner described below. Specifically, the feeding unit 10 is operated by a controller (not shown) and, as shown in FIG. 2, the feed roller 11 conveys the sheets 99 placed on the sheet holding surface 50A and plate 60. The separation roller 12 and the separation pad 13 separate the fed sheets 99 one by one. The convey roller 14A and the driven roller 14B convey the separated sheet 99 to the image forming unit 20.

The image forming unit 20 is operated as the feeding unit 10 conveys the sheet 99. The charger 25 rotates and uniformly and positively charges the surface of the photosensitive drum 21. Then, the surface of the photosensitive durum 21 is exposed to a laser beam emitted from the scanning unit 29. Consequently, the scanning unit 29 forms an electrostatic latent image on the surface of the photosensitive drum 21, the electrostatic latent image corresponding to an image to be formed. Then, toner is supplied from the toner container 24 to the electrostatic latent image formed on the surface of the photosensitive drum 21. Consequently, a toner image corresponding to the electrostatic latent image is carried on the surface of the photosensitive drum 21. When the photosensitive drum 21 rotates while contacting the conveyed sheet 99, and negative voltage is applied to the transfer roller 27, the toner image is transferred to the sheet 99.

The sheet 99 to which the toner image has been transferred is further conveyed in the substantially vertical direction along the conveying path P1 and then reaches the fixing unit 30. Then, the heat roller 31 of the fixing unit 30 heats the sheet 99. The pressure roller 32 presses the sheet 99 against the heat roller 31 to apply pressure to the sheet 99. Consequently, the toner image is fixed to the sheet 99 by the fixing unit 30. Then, the sheet 99 is discharged from the discharge port 88 to the discharge tray 87 by the discharge roller 19A and the driven roller 19B. In this way, the image forming device 1 completes the image forming on the sheet 99.

Figure 5:
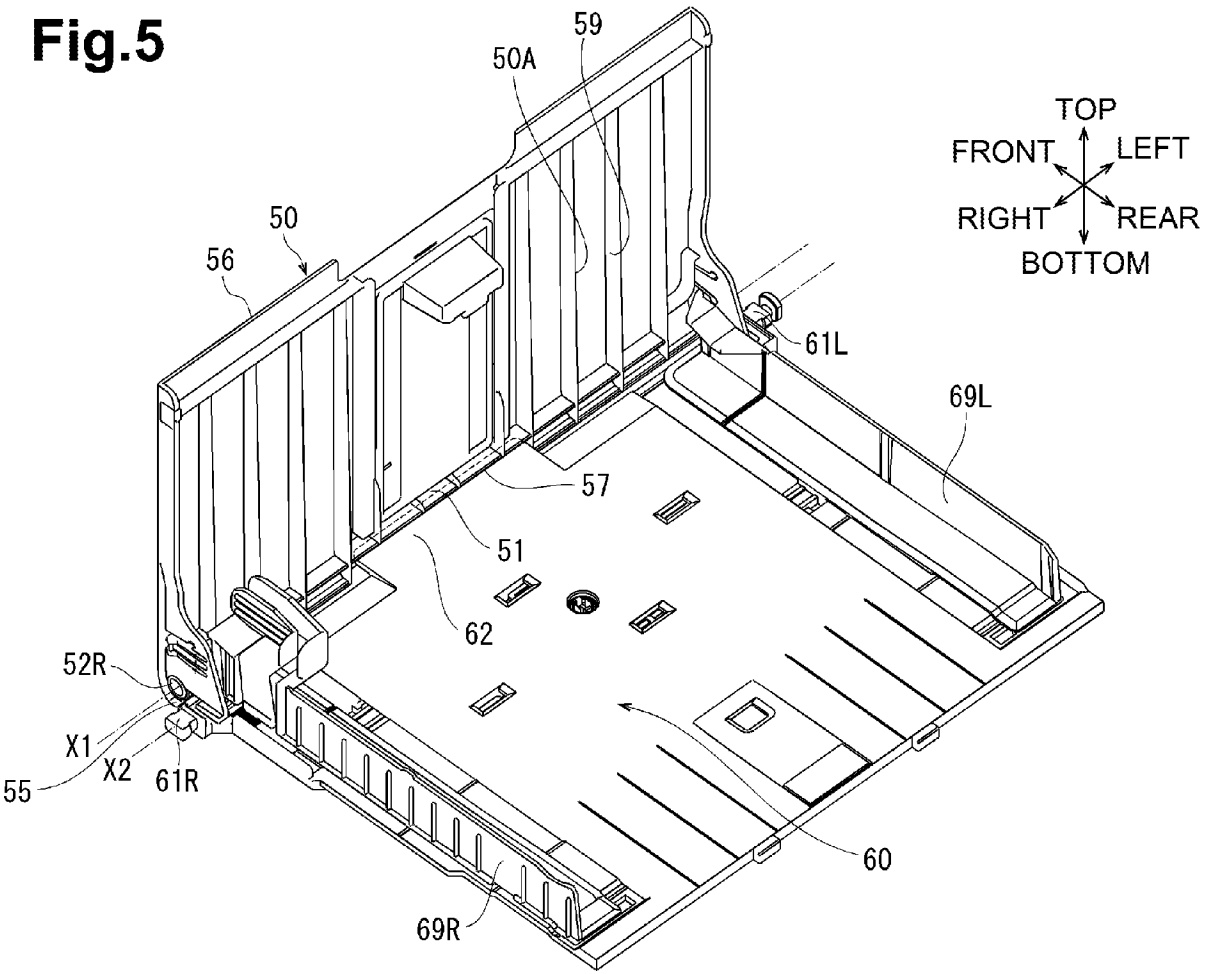
FIG. 5 is a perspective view relating to the image forming device and showing the tray cover in the closed position and the plate.
Figure 6:
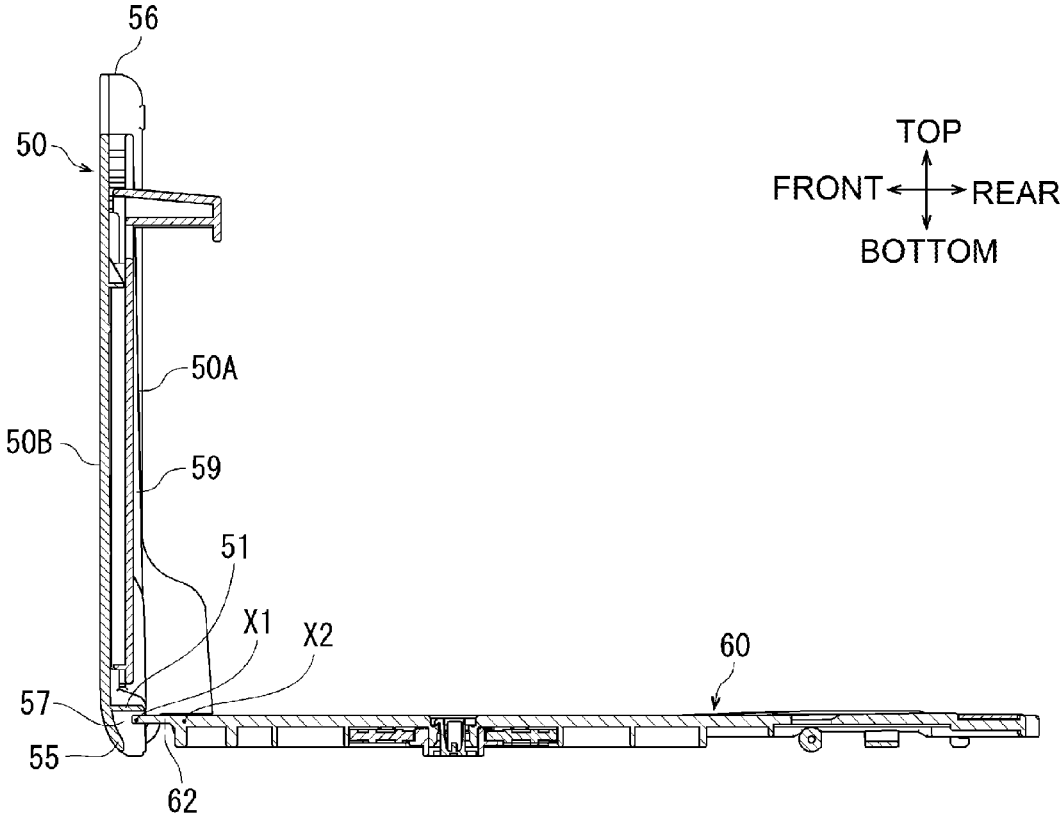
FIG. 6 is a cross-sectional view relating the image forming device and showing the tray cover in the closed position and the plate.
Figure 7:
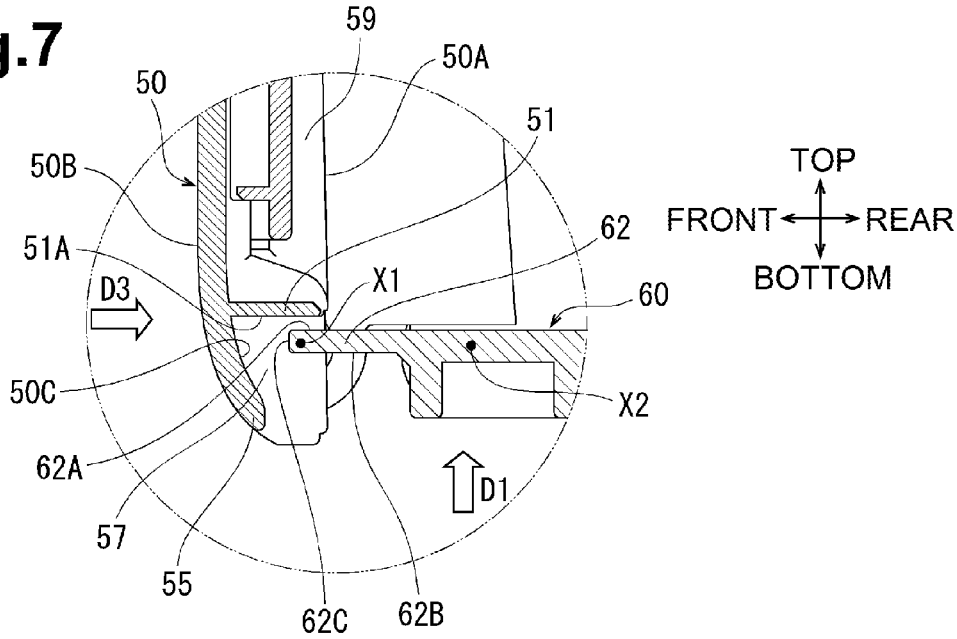
FIG. 7 is an enlarged partial cross-sectional view relating to the image forming device and showing the tray cover in the closed position and the plate.
Figure 9:
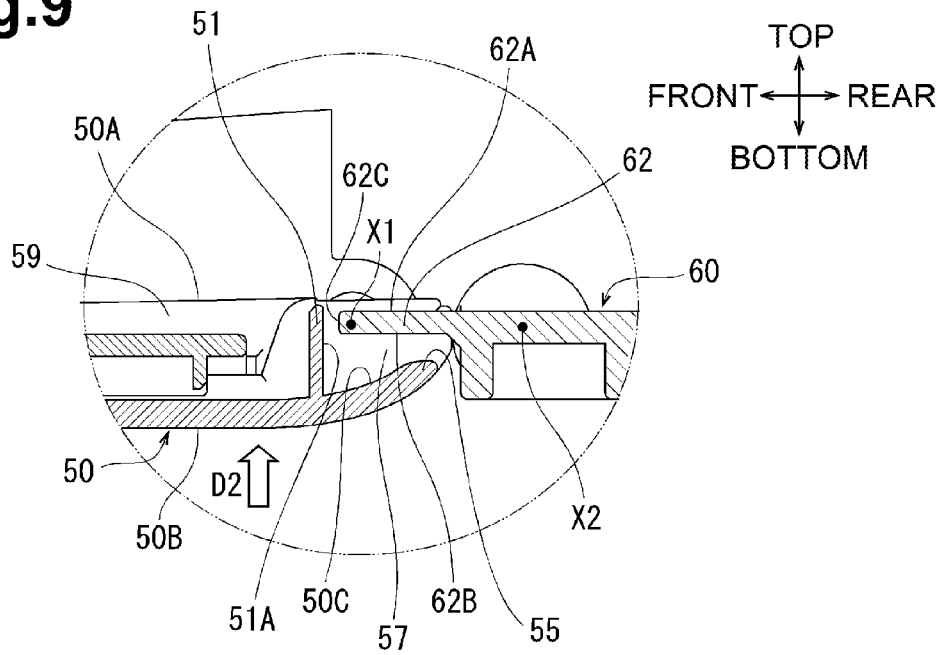
FIG. 9 is an enlarged partial cross-sectional view relating to the image forming device and showing the tray cover in the open position and the plate.
Figure 10:
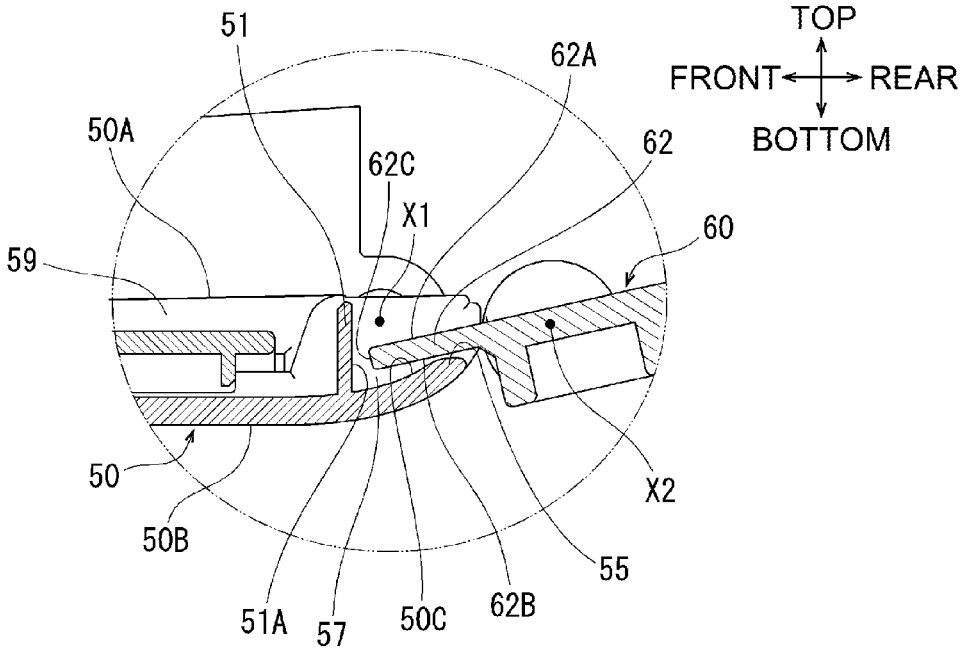
FIG. 10 is an enlarged partial cross-sectional view relating to the image forming device and showing the tray cover in the open position and the plate which is inclined.

As shown in FIGS. 5 to 7, 9 and 10, the tray cover 50 comprises an edge portion 55 provided near the first axis X1 so as to extend in the left-right direction. In a state in which the tray cover 50 is in the closed position as shown in FIGS. 5 to 7, the edge portion 55 is positioned below the first axis X1. This structure enables the tray cover 50 to cover even the lower end of the main body 8. In a state in which the tray cover 50 is in the open position as shown in FIGS. 9 and 10, the edge portion 55 is positioned between the first axis X1 and the second axis X2 in the front-rear direction and below the first and second axes X1 and X2.

Figure 8:
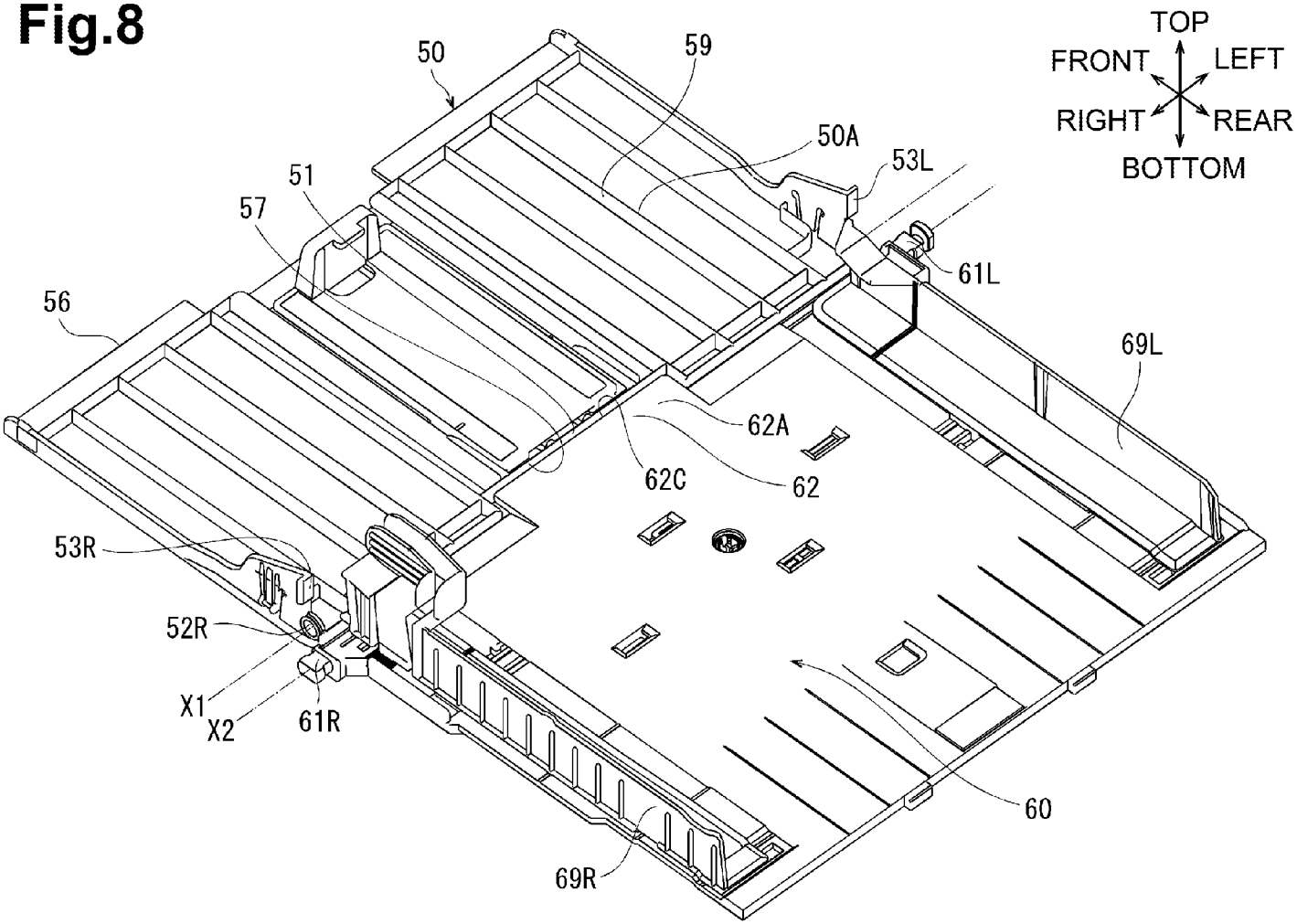
FIG. 8 is a perspective view relating to the image forming device and showing the tray cover in an open position and the plate.

As described above, the height H1 of the first axis X1 is equal to the height H2 of the second axis X2. As shown in FIG. 8, the tray cover 50 comprises a pair of left and right stoppers 53L and 53R integrally formed therewith in the vicinity of the cover-side shaft holes 52L and 52R, respectively. The stoppers 53L and 53R mate with engagement portions (not shown) provided to the inner side frames 80L and 80R, respectively, such that the tray cover 50 is held in the open position.

As shown in FIGS. 6 and 7, the tray cover 50 has an outer surface 50B which has a planar shape extending from a free edge portion 56 of the tray cover 50 to the vicinity of the first axis X1 substantially in parallel with the sheet holding surface 50A. The free edge portion 56 is opposite from the edge portion 55. The outer surface 50B is circularly curved from the vicinity of the first axis X1 to the edge portion 55.

As shown in FIGS. 5 and 8, the tray cover 50 has a recess 57. The recess 57 is formed by cutting out the middle part of the edge portion 55 in the left-right direction toward the free edge portion 56. The recess 57 is positioned between the left cover-side shaft hole 52L and the right cover-side shaft hole 52R and provides an elongate space in the left-right direction.

As shown in FIGS. 5 to 10, the tray cover 50 comprises a first protrusion 51 integrally formed therewith. The first protrusion 51 is in the form of a rib protruding from the side near the outer surface 50B toward the sheet holding surface 50A.

As shown in FIG. 7, the first protrusion 51 has a wall surface 51A extending in the left-right direction and facing the first axis X1, and the wall surface 51A serves as one of the inner wall surfaces defining the recess 57. The first protrusion 51 is positioned opposite to the edge portion 55 relative to the first axis X1. The first axis X1 is interposed between the first protrusion 51 and the edge portion 55.

In a state in which the tray cover 50 is in the closed position, the first protrusion 51 protrudes in the direction in which the sheet 99 is fed, namely, in the direction from the front surface 8F of the main body 8 to the rear surface 8R. However, the first protrusion 51 protrudes in the sheet feeding direction so as not to reach the sheet holding surface 50A. As shown in FIG. 9, the first protrusion 51 is therefore lower than the sheet holding surface 50A in a state in which the tray cover 50 is in the open position. In addition, in a state in which the tray cover 50 is in the open position, the edge portion 55 is positioned lower than the tip of the first protrusion 51.

As shown in FIGS. 5 to 10, the plate 60 comprises a second protrusion 62 integrally formed therewith. The second protrusion 62 is positioned between the left plate-side shaft 61L and the right plate-side shaft 61R. The second protrusion 62 has a flat plate shape extending substantially horizontally and elongate in the left-right direction. The second protrusion 62 protrudes in the direction opposite to the sheet feeding direction, namely, in the direction from the rear surface 8R to the front surface 8F of the main body 8. The second protrusion 62 protrudes into the recess 57. In other words, the second protrusion 62 is a central protrusion which protrudes toward the tray cover 50 from a central portion of the plate 60 with respect to a direction along the second axis X2.

The second protrusion 62 has an upper surface 62A flush with the upper surface of the plate 60 as shown in FIG. 7. The second protrusion 62 has a thickness smaller than that of the plate 60. The second protrusion 62 has a front edge 62C protruding frontward so as to intersect the first axis X1.

In a state in which the tray cover 50 is in the closed position, the upper surface 62A of the second protrusion 62 faces the wall surface 51A of the first protrusion 51 while being spaced below from the wall surface 51A. The distance between the upper surface 62A and the wall surface 51A in the top-bottom direction is, for example, from 0.1 millimeters to approximately a few millimeters. In particular, when the middle part of the plate 60 held at its two ends in the left-right direction is deformed upward, the wall surface 51A contacts the upper surface 62A. In other words, the upper surface 62A is spaced below from the wall surface 51A by a distance that is within a range in which the plate 60 is elastically deformable. Such a clearance is provided even when a maximum amount of sheets are placed on the plate 60. As shown in FIG. 7, in a state in which the tray cover 50 is closed, the wall surface 51A is substantially parallel to the upper surface 62A. The wall surface 51A of the first protrusion 51 is an example of a first surface, and the upper surface 62A of the second protrusion 62 is an example of a second surface.

In a state in which the tray cover 50 is in the closed position, the front edge 62C of the second protrusion 62 faces an inner surface 50C of the tray cover 55 while being spaced rearward from the inner surface 50C. The inner surface 50C is positioned between the edge portion 55 of the tray cover 50 and the first protrusion 51 and serves as one of the inner wall surfaces defining the recess 57. The distance between the front edge 62C and the inner surface 50C in the front-rear direction is, for example, from 0.1 millimeters to approximately a few millimeters. In particular, in a state in which the tray cover 50 is in the closed position, when the middle part of the tray cover 50 held at its two ends in the left-right direction is deformed rearward, the front edge 62C is able to contact the inner surface 50C.

As shown in FIG. 9, the upper surface 62A of the second protrusion 62 is lower than the sheet holding surface 50A in a state in which the tray cover 50 is in the open position. The upper surface 62A of the second protrusion 62 is therefore spaced downward from the sheets 99 on the sheet holding surface 50A, and thus the second protrusion 62 is unlikely to interfere with the feeding of the sheets 99.

In a state in which the tray cover 50 is in the open position, a lower surface 62B of the second protrusion 62 faces the edge portion 55 while being spaced upward therefrom. The distance between the lower surface 62B and the edge portion 55 in the top-bottom direction is, for example, from 1 millimeter to approximately a few millimeters. In particular, in a state in which the tray cover 50 is in the open position, when the middle part of the tray cover 50 held at its two ends in the left-and right direction is deformed upward, the lower surface 62B is able to contact the edge portion 55.

As shown in FIG. 10, in the case where the plate 60 pivots about the second axis X2 depending on the number of the sheets 99 on the plate 60, the lower surface 62B of the second protrusion 62 approaches the edge portion 55. In the present embodiment, the distance between the lower surface 62B and the edge portion 55 in the top-down direction is sufficiently secured so that the lower surface 62B does not contact the edge portion 55 in such a case. Thus, the edge portion 55 of the tray cover 50 is unlikely to interfere with the second protrusion 62 of the plate 60.

In the image forming device 1 of the above-described embodiment, in a state in which the tray cover 50 is in the closed position as shown in FIG. 7, the tray cover 50 is positioned on an upper side of the plate 60 so as to be contactable with the upper surface 62A of the second protrusion 62, which is at least a part of the plate 60. The second protrusion 62 is a middle part of the plate 60 with respect to a direction along the second axis X2 and is closer to the tray cover 50 than the second axis X2. Thus, in a state in which the tray cover 50 is in the closed position, when the plate 60 is deformed upward in the direction shown by an arrow D1 in FIG. 7, the wall surface 51A of the first protrusion 51 contacts the upper surface 62A of the second protrusion 62 from above. This can restrict excessive deformation of the plate 60. Thus, breakage of the plate 60 can be reliably prevented in the image forming device 1. Because, in the image forming device 1, excessive deformation of the plate 60 can be restricted, it is possible to reduce the thickness of the plate 60 and eliminate a reinforcing member, such as a metallic plate, from the plate 60. Thus, the size of the plate 60 can be reduced in the height direction of the sheet forming device 1.

Accordingly, the image forming device 1 of the above-described embodiment can prevent breakage of the plate 60 and achieve a reduction in size in its height direction. Furthermore, elimination of a reinforcing member for the plate 60 leads to a decrease in the number of components to be used, which readily enables a reduction in production costs.

As shown in FIGS. 2 and 4, the image forming device 1 comprises the bottom plate 8D covering the rear edge side of the plate 60 but omits a plate cover for covering a more frontward region of the plate 60 than the bottom plate 80 and for preventing the region from being exposed to the mounting surface G1. This structure enables the image forming device 1 to decrease the number of components to be used, which leads to a reduction in production costs. In the sheet forming device 1, a user may hold by hand the plate 60 which is exposed to the mounting surface G1, or foreign objects on the mounting surface G1 may interfere with the plate 60. This may cause the plate 60 to deform upward in the direction shown by the arrow D1 in FIG. 7. In this case, in a state in which the tray cover 50 is in the closed position, the wall surface 51A of the first protrusion 51 contacts the upper surface 62A of the second protrusion 62 from above so as to restrict excessive deformation of the plate 60. Thus, breakage of the plate 60 can be reliably prevented in the image forming device 1.

In the image forming device 1, in a state in which the tray cover 50 is in the open position as shown in FIG. 9, the lower surface 62B of the second protrusion 62, which is at least a part of the plate 60, is positioned on an upper side of the edge portion 55 so as to be contactable with the edge portion 55. In a state in which the tray cover 50 is in the open position, a user may hold by hand the tray cover 50, or foreign objects on the mounting surface G1 may interfere with the tray cover 50. This may cause the edge portion 55 of the tray cover 50 to deform upward in the direction shown by an arrow D2 in FIG. 9. In this case, the lower surface 62B of the second protrusion 62 contacts the edge portion 55 from above so as to restrict excessive deformation of the tray cover 50. Thus, breakage of the tray cover 50 can be reliably prevented in the image forming device 1.

In the image forming device 1, because the edge portion 55 is positioned opposite to the first protrusion 51 relative to the first axis 1, the edge portion 55 intrudes into the space under the second protrusion 62 of the plate 60 in a state in which the tray cover 50 is in the open position as shown in FIG. 9. In addition, because the edge portion 55 is positioned lower than the tip of the first protrusion 51, the edge portion 55 is unlikely to interfere with the second protrusion 62.

In the image forming device 1, in a state in which the tray cover 50 is in the closed position as shown in FIG. 7, the front edge 62C of the second protrusion 62 is positioned in the rear of the inner surface 50C of the tray cover 50 so as to be contactable with the inner surface 50C. In a state in which the tray cover 50 is in the closed position, a user may push the tray cover 50 toward the interior of the main body 8, or foreign objects may interfere with the tray cover 50. This may cause the tray cover 50 to deform toward the interior of the main body 8 in the direction shown by an arrow D3 in FIG. 7. In this case, the front edge 62C of the second protrusion 62 contacts the inner surface 50C of the tray cover 50 from the rear side to restrict excessive deformation of the tray cover 50. Thus, breakage of the tray cover 50 can be reliably prevented in the image forming device 1.

In the image forming device 1, in a state in which the tray cover 50 is in the open position as shown in FIG. 9, the first protrusion 51 is positioned lower than the sheet holding surface 50A. The first protrusion 51 is therefore spaced downward from the sheets 99 on the sheet holding surface 50A and is unlikely to interfere with the feeding of the sheets 99.

The height H1 of the first axis X1 is equal to the height H2 of the second axis X2. The image forming device 1 therefore can achieve a further reduction in size in its height direction as compared with a case in which the height H1 of the first axis X1 differs from the height H2 of the second axis X2.

Although the first protrusion 51 is a rib in the above-described embodiment, the first protrusion 51 is not limited to such a structure. For example, the first protrusion may be a cylindrical member or a boss. The same holds true for the structure of the second protrusion.

Although, in the above-described embodiment, the tray cover 50 serves as both the cover for closing the opening 89 and the tray on which the sheets 99 are placed, the tray cover 50 is not be limited to such a structure. For example, the tray cover 50 may not serve as a tray.

In the above-described embodiment, in a state in which the tray cover 50 is in the closed position, a clearance is provided between the first protrusion 51 of the cover 50 and the second protrusion 62 of the plate 60, and a clearance is provided between the inner surface 50C of the first protrusion 51 and the second protrusion 62. However, such clearances may not be provided as long as the tray cover 50 is pivotable properly about the first axis X1.

In the above-described embodiment, in a state in which the tray cover 50 is in the open position, a clearance is provided between the edge portion 55 of the cover 50 and the second protrusion 62. However, such a clearance may not be provided as long as the plate 50 is pivotable properly about the second axis X2.

The sheet feeding device according to the present invention may be applied to, for example, an image forming device, an image scanning device, and a multi-function device.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A sheet feeding device comprising:

a main body comprising a feeding unit configured to feed a sheet in a feeding direction to a conveying path along which the sheet is conveyed;

a cover configured to pivot about a first axis relative to the main body between a closed position in which the cover closes the conveying path and an open position in which the cover exposes the conveying path; and a plate configured to pivot about a second axis which is parallel to the first axis so as to contact and move away from the feeding unit, wherein the second axis is closer to the cover than to the feeding unit in the feeding direction, wherein opposite end portions of the plate in a direction along the second axis are supported by the main body such that the plate pivots about the second axis, and wherein when the cover is in the closed position, at least a part of the cover is positioned on an upper side of a middle part of the plate between the opposite end portions and is configured to contact the middle part of the plate.

2. The sheet feeding device according to claim 1, wherein the plate extends toward a side of the main body opposite from the cover in the open position.

3. The sheet feeding device according to claim 1, wherein the sheet feeding device is configured to be mounted on a mounting surface, and wherein the plate is exposed to the mounting surface when the sheet feeding device is on the mounting surface.

4. The sheet feeding device according to claim 3, wherein a portion of the middle part of the plate which is closer to the cover than to the feeding unit is exposed to the mounting surface.

5. The sheet feeding device according to claim 1, wherein the part of the cover comprises a first protrusion which, when the cover is in the closed position, protrudes in the feeding direction and is positioned on the upper side of the middle part of the plate and is configured to contact the middle part of the plate.

6. The sheet feeding device according to claim 5, wherein the cover comprises an edge portion positioned opposite to the first protrusion relative to the first axis, and wherein when the cover is in the open position, the middle part of the plate is positioned on an upper side of the edge portion of the cover and is configured to contact the edge portion.

7. The sheet feeding device according to claim 6, wherein when the cover is in the open position, the edge portion is lower than a protruding end of the first protrusion.

8. The sheet feeding device according to claim 6, wherein the middle part of the plate comprises a second protrusion which protrudes further than the second axis in a direction opposite to the feeding direction and which, when the cover is in the open position, is positioned on the upper side of the edge portion of the cover and is configured to contact the edge portion.

9. The sheet feeding device according to claim 8, wherein when the cover is in the closed position, the second protrusion is configured to contact the first protrusion of the cover.

10. The sheet feeding device according to claim 8, wherein when the cover is in the open position, the edge portion of the cover is spaced below the second protrusion.

11. The sheet feeding device according to claim 5, wherein the cover comprises a holding surface configured to hold the sheet to be conveyed in the feeding direction, wherein when the cover is in the open position, the holding surface faces up, and wherein when the cover is in the open position, the first protrusion is lower than the holding surface.

12. The sheet feeding device according to claim 5, wherein the middle part of the plate comprises a second protrusion which protrudes further than the second axis in a direction opposite to the feeding direction, and wherein when the cover is in the closed position, the first protrusion is positioned on an upper side of the second protrusion and is configured to contact the second protrusion.

13. The sheet feeding device according to claim 1, wherein the sheet feeding device is configured to be mounted on a mounting surface, and wherein when the sheet feeding device is on the mounting surface, a height of the first axis with respect to the mounting surface is equal to a height of the second axis with respect to the mounting surface.

14. The sheet feeding device according to claim 1, wherein the part of the cover comprises a first surface and the middle part of the plate comprises a second surface, and wherein when the cover is in the closed position, the first surface is substantially parallel to the second surface and is positioned on an upper side of the second surface and is configured to contact the second surface.

15. The sheet feeding device according to claim 1, wherein when the cover is in the closed position, the part of the cover is positioned on an upper side of a closer portion of the middle part of the plate and is configured to contact the closer portion, wherein the closer portion is closer to the cover than the second axis is to the cover.

16. The sheet feeding device according to claim 1, wherein when the cover is in the closed position, the part of the cover contacts an upper surface of the middle part of the plate in response to the middle part of the plate being deformed by an external force.

17. The sheet feeding device according to claim 1, wherein the plate is made of resin.

18. The sheet feeding device according to claim 1, wherein the plate is configured to be elastically deformed such that a first edge of the middle part of the plate is configured to move from an undeformed position to a deformed position defining a range in which the plate is elastically deformable, and wherein when the cover is in the closed position, the middle part of the plate is spaced below the part of the cover by a distance that is within the range in which the plate is elastically deformable.

19. The sheet feeding device according to claim 18, wherein when the cover is in the closed position, the plate, when supporting a maximum amount of sheets which the sheet feeding device is configured to accommodate, is spaced below the part of the cover by the distance that is within the range in which the plate is elastically deformable.

* * * * *